US005924552A

United States Patent [19]

Yu

[11] Patent Number: 5,924,552

[45] Date of Patent: Jul. 20, 1999

[54] RETAINER STRUCTURE OF SWITCH

[76] Inventor: Tsung-Mou Yu, No. 4, Alley 2, Lane 23, Sec. 3, Pa Te Toad, Panchiao, Taipei, Taiwan

[21] Appl. No.: 08/905,735

[22] Filed: Aug. 4, 1997

[51] Int. Cl.[6] ..... H01H 9/02

[52] U.S. Cl. ..... 200/296; 200/293

[58] Field of Search ..... 200/296, 295, 200/293, 553, 339, 554, 555, 556, 557, 558

[56] References Cited

U.S. PATENT DOCUMENTS

| | | | |
|---|---|---|---|
| 5,041,706 | 8/1991 | Osika et al. | 200/296 |
| 5,105,059 | 4/1992 | Sorenson et al. | 200/296 |
| 5,343,007 | 8/1994 | Roeser et al. | 200/296 |

*Primary Examiner*—David J. Walczak
*Attorney, Agent, or Firm*—Browdy and Neimark

[57] ABSTRACT

A retainer structure of switch including a hollow main body, a removable cover, and separable elastic clip elements. Each of two opposite sides outside the main body has an inlay groove, where the hook from the extension plate of the convex clip element is inserted and fixed to the inlay groove respectively. The upper slope of the convex elastic clip element has a rough surface where the clip element is elastically deformed when the switch is to be inserted to the specified cavity and then resumes to its original position after the clip element is fully inserted into the mounting cavity to form a firm and tide fixation. The relevant electronic components are inserted into the hollow space of the main body, together with the elastic clip elements, the switch is then covered up by the removable cover to form the retaining structure of switch.

6 Claims, 3 Drawing Sheets

RETAINER STRUCTURE OF SWITCH

FIELD OF THE INVENTION

The present invention relates generally to a switch, in particular to a separate retainer structure of the switch which is made by a stronger elastic material and then fixed into the main body to provide a better clipping strength. Meanwhile, the said retainer structure may be replaced independently if it has been broken, and to reduce the cost of replacing the switch as a whole.

BACKGROUND OF THE INVENTION

The conventional rocker switch as illustrated in FIG. 4 having the retainer structure of the switch formed on the two opposite sides of the main body A together with the relevant electronic components inserted within, then covered inside the main body A of the switch to form a unitary unit. Only the actuator and the conductors B connected to the inner electrical circuit are shown outside the main body A. After the rocker switch is inserted into the specified cavity, the conductors B are then connected to pre-set wires where the power is supplied and the current flow is being controlled by the actuator. In order to allow the main body A stable and firmly fixed to the specified cavity (not shown in the drawing), the retainer is identified as the convex configurated clip element A1 made of elastic spring material which is elastically deformed when the main body A is being inserted into the respective cavity and then resumes to its original position after the clip element A1 is fully inserted into the cavity. Meanwhile, the electrical components are inserted and covered up within the main body A during the process of switch making. However, the following deprivations remain in the prior art articles:

1. Since the main body and the clip element forms a single unitary unit, they are usually made of same material. During the process of inserting the main body into the specified cavity, the elastic clip element may be broken due to repeated pressing and pushing. The main body of the clip switch as a whole is then required to be replaced once the clip element is broken.
2. All the relevant electronic components are inserted and covered within the main body. If any of the components is defected, the part itself individually can not be replaced, which means that the clip switch as a whole needs to be replaced.

From the above points given, the conventional clip switch seems to be uneconomical and unfriendly to our environment. Based on these, the present invention provides a clip switch having separable retainer structure to overcome these problems and disadvantages and give a better living surrounding.

SUMMARY OF THE INVENTION

It is an object of the present invention to provide a clip switch having a separable retaining structure. The retaining clip element is made by a stronger elastic spring material independently in comparison with the main body of the switch and then fixed to the two sides of the main body. If the retaining clip element is broken, the clip element can be replaced individually to reduce the cost of replacing the switch as a whole and furthermore to extend the product life time of the clip switch.

It is another object of the present invention to provide a clip switch, where the main body has an opening which is covered up by a cover, i.e. the hollow main body having separated cover is covered up after insertion of the electronic components, and the defected component therein may be replaced individually by removing the cover from the main body.

To accomplish these and other objects, according to one aspect of the present invention, a clip switch with separable retainer is provided, comprising a hollow main body having an opening for the insertion of the relevant electronic components. An inlay groove is formed respectively on each of two opposite sides of the main body. The inner surface of the inlay groove defines a clip brim, where its respective opposite sides forms a slope. The retaining clip which is made of a stronger elastic spring material in comparison with the main body consists of a clip hook which is clipped onto the clip brim of the inlay groove to form a slope, at the same time providing an appropriate elasticity for the clip switch. A convex configuration is defined on the top of the retaining clip element with its upper half of the convex being rough-surfaced to allow a strong attachment to be formed between the main body and specified cavity. The retaining clip elements and the main body are then covered up by the cover body.

The structure and features of the present invention will become more apparent from the coming up detailed description and the illustration of the drawings.

DETAILED DESCRIPTION OF THE PREFERRED EMBODIMENT

Figure 1:
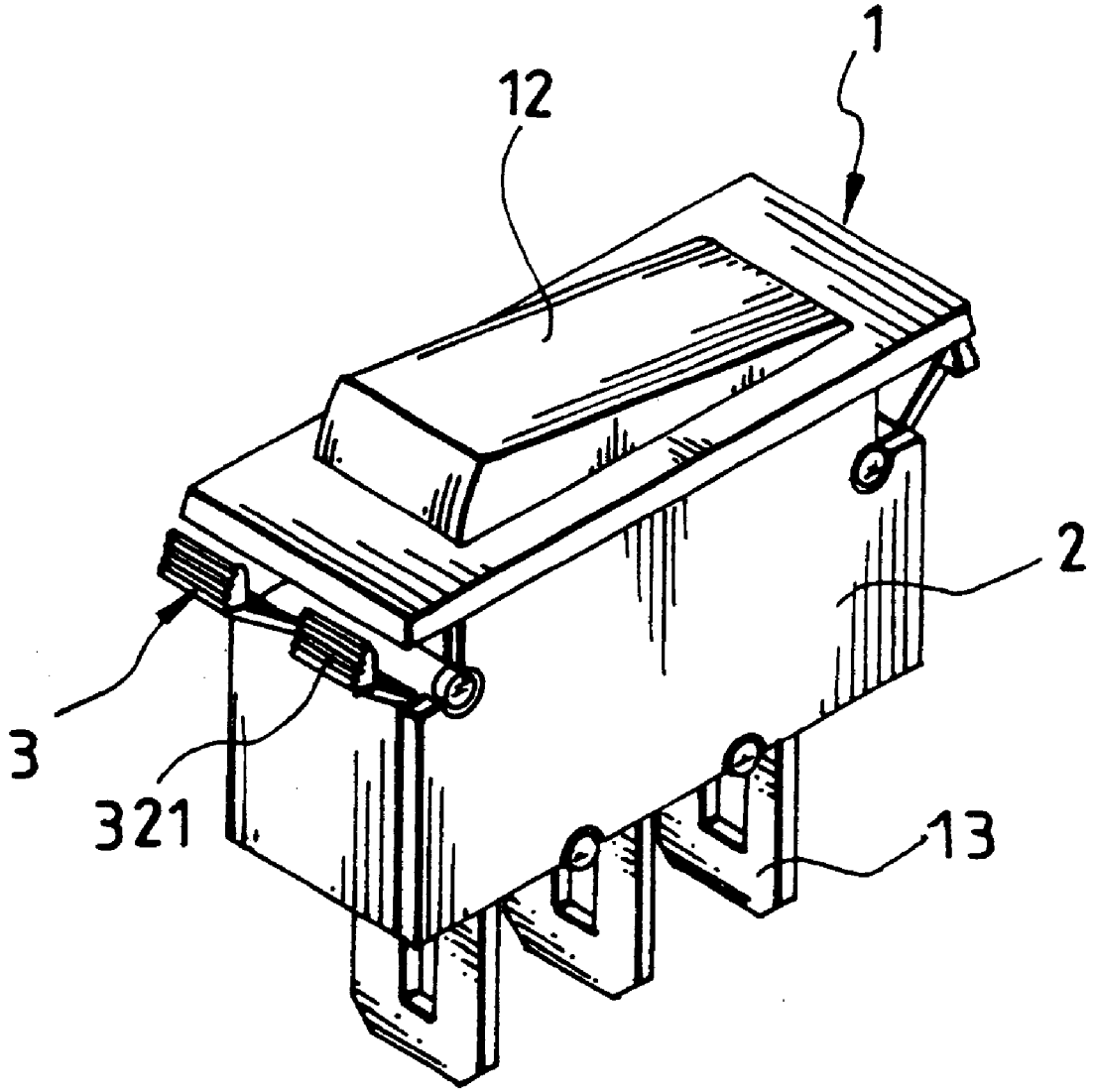
FIG. 1 is a perspective view of a clip switch in accordance to the present invention.
Figure 2:
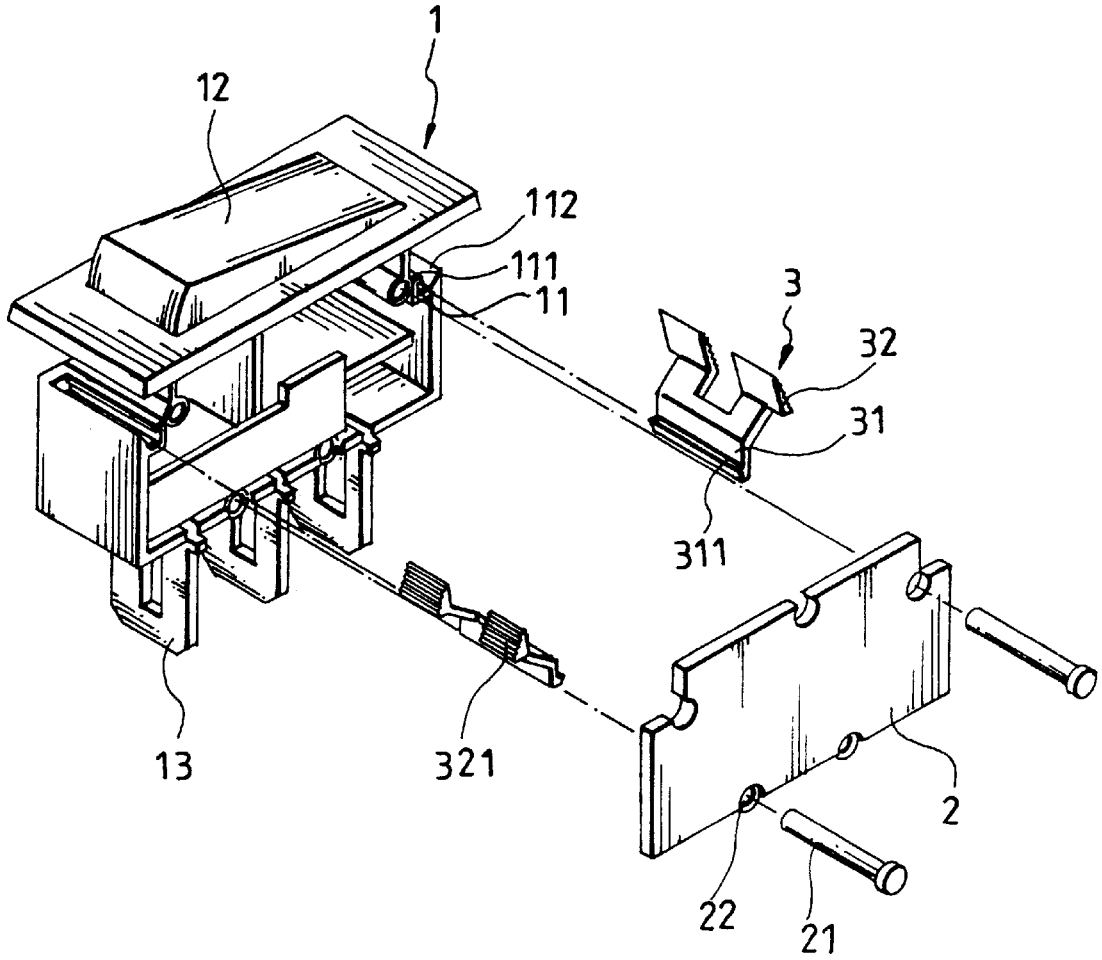
FIG. 2 is an exploded view of the clip switch according to the present invention.

From the illustration of FIGS. 1 and 2, a clip switch having separable retaining clip elements 3 according to the present invention is shown. The clip switch comprises a hollow body 1 defining an interior space for reception of the relevant electronic components, a cover 2 to cover up the side opening of the hollow main body 1 so as to close the interior space and the retaining clip elements 3. The actuator 12 and conductors 13 come out respectively from the top and bottom of the main body 1 so that the conductors 13 can be connected to pre-set wires in the specified cavity (not shown) for power supply. Each of two opposite sides outside the main body 1 forms an (or, inlaid) inlay groove 11. One side of the inner surface of the inlay groove 11 has a clip brim 111 where the inner surface of the inlay groove 11 opposite the clip brim 111 forms a slope 112. The retaining clip element 3 with convex structure comprises an extension plate 31 coming out the bottom side of the convex retaining clip element. On the bottom edge of the extension plate 31 is a clip hook 311, whereas the upper slope 32 of the convex retaining clip element 3 has a rough surface 321, preferably toothed.

Figure 3:
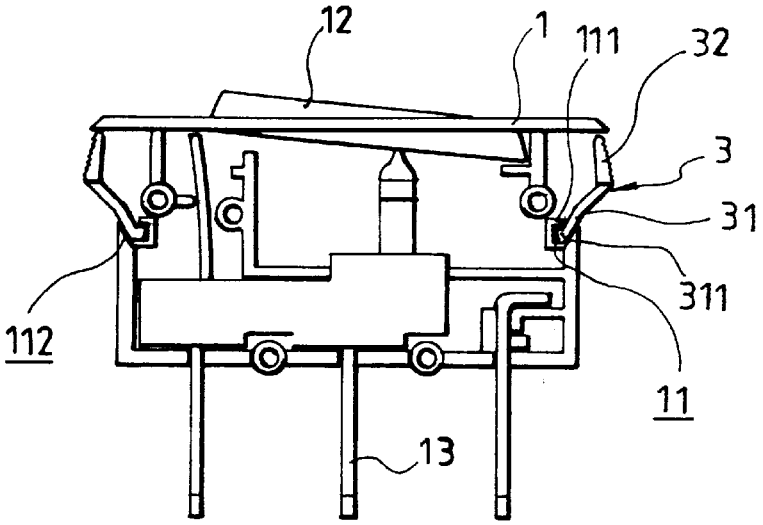
FIG. 3 is a cross-sectional vies of the clip switch according to the present invention.
Figure 4:
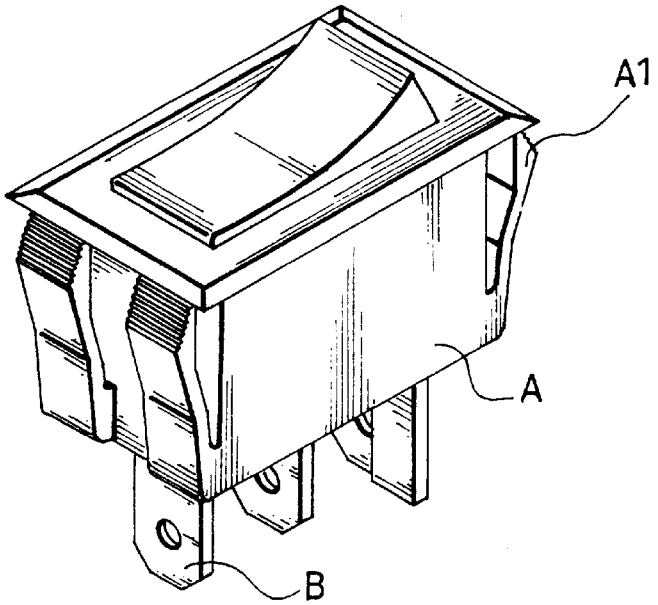
FIG. 4 shows a perspective view of a prior art clip switch.

With the inlay groove 11 and the retaining clip element 3 being so structured, the extension plate 31 of the retaining clip element 3 is inserted into the inlay groove 11 with the clip hook 311 formed on the edge of the extension plate 31 hooks onto the clip brim 111 of the inlay groove 11, and as a result, the retaining clip element 3 is held in the inlay groove 11 (as shown in FIG. 3) and the other side of the extension plate 31 is coherent with the slope surface 112 respectively to form a slope. The cover 2 is then placed on the opening of the hollow main body 1, by inserting the fixation rods 21 into respective fixation cavities 22, the main body 1 together with the retaining clip elements 3 are covered up. Through the elasticity of the retaining clip element 3, in mounting the clip switch into a specified cavity, the clip element 3 is elastically deformed to allow main body 1 and the clip element 3 to be inserted into the mounting cavity. The separable retaining clip elements 3 then resume their original positions and are firmly fixed onto the edge of the cavity after the clipper 32 at the top of the retaining clip element 3 past through the mounting cavity.

At least the following advantages may be achieved by the present invention:

1. The retaining clip elements and the main body are separate individual: the retaining clip element may be made of a stronger elastic spring material to strengthen up the separable retaining clip element. Therefore, if the clip element is broken, the cover can be removed whereas the clip element is then replaced from the main body without replacing the main body as a whole from the mounting cavity in order to save costs.
2. The cover of the main body can be removed: The relevant electronic components are inserted into the main body and then covered up with the cover. Therefore, if any of the said elements is defected or broken, with proper tools, the components can be replaced from the interior of the main body without replacing the whole switch set to give a better economical value.

Although only the preferred embodiment of this invention is shown and described above, it will be understood by the person skilled in the art that various changes in form and detail may be made without departing from the spirit and scope of the invention. It is requested that any modification and/or combination that come within the spirit of this invention be protected.

What is claimed is:

1. A switch having a retaining structure, comprising:

a hollow main body (1) including an opening and an inlaid groove having a side groove opening (11) on each of two opposite ends of said main body;

a separable retaining clip element (3) received and fixed inside each respective inlaid groove, the clip element including a convex structure comprising an extension plate (31) extending from a bottom part thereof and a clip hook (311) formed on an edge of the extension plate, wherein the clip is hooked into the inlaid groove; and a removable cover (2) covering the opening and each of said side groove openings to thereby secure each of said clip elements within a respective said groove.

2. The switch according to claim 1, wherein a first inner surface of the inlaid groove includes a slope (112) and a second inner surface includes a clip brim (111).

3. The switch according to claim 1, wherein an upper part of the convex structure includes a rough surface.

4. The switch according to claim 3, wherein the rough surface is toothed.

5. The switch according to claim 1, wherein the main body comprises a side, the side including the opening, and a top wherein a rockable actuator (12) is mountable.

6. The switch according to claim 1, wherein the retaining clip element comprises means for mounting the switch.

* * * * *